United States Patent [19]

Sartor

[11] 4,280,286

[45] Jul. 28, 1981

[54] SKI BOOT

[75] Inventor: Mariano Sartor, Montebelluna, Italy

[73] Assignee: Nordica S.p.A., Montebelluna, Italy

[21] Appl. No.: 90,816

[22] Filed: Nov. 2, 1979

[30] Foreign Application Priority Data

Nov. 15, 1978 [IT] Italy ..... 298131 A/78

[51] Int. Cl.[3] ..... A43B 5/04; A43B 21/00

[52] U.S. Cl. ..... 36/118; 36/105; 36/121

[58] Field of Search ..... 36/117, 118, 120, 121, 36/105

[56] References Cited

U.S. PATENT DOCUMENTS 3,820,256 6/1974 Schoch ..... 36/120

4,078,322 3/1978 Dalebout ..... 36/121

4,186,501 2/1980 Salomon ..... 36/121

FOREIGN PATENT DOCUMENTS 2805943 8/1979 Fed. Rep. of Germany ..... 36/118

2230155 12/1974 France ..... 36/118

*Primary Examiner*—Patrick D. Lawson

*Attorney, Agent, or Firm*—Guido Modiano; Albert Josif

[57] ABSTRACT

A ski boot comprises a plastics material shell, wherewith are associated a raised upper and a raised vamp, this latter being effective to cover the skier's leg front along the tibia and engage laterally the skier's leg, the raised upper and vamp being both hinged to said shell for pivoting about a substantially horizontal axis extending perpendicularly to the shell centerline.

4 Claims, 9 Drawing Figures

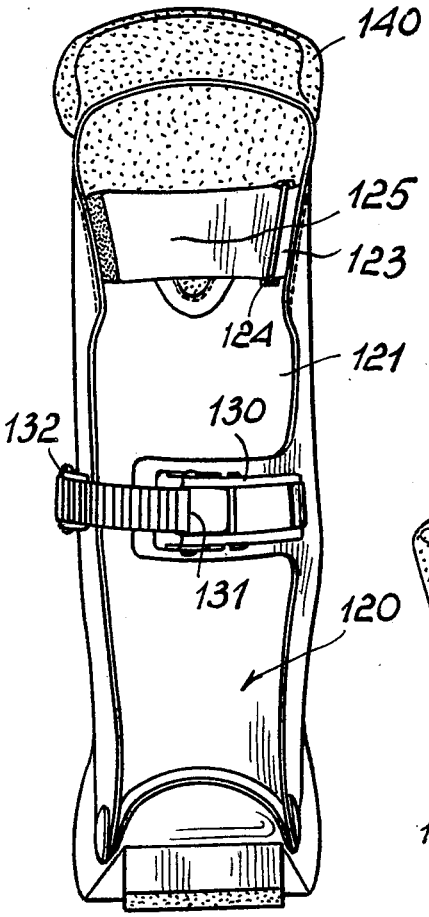
Fig. 5
Fig. 4
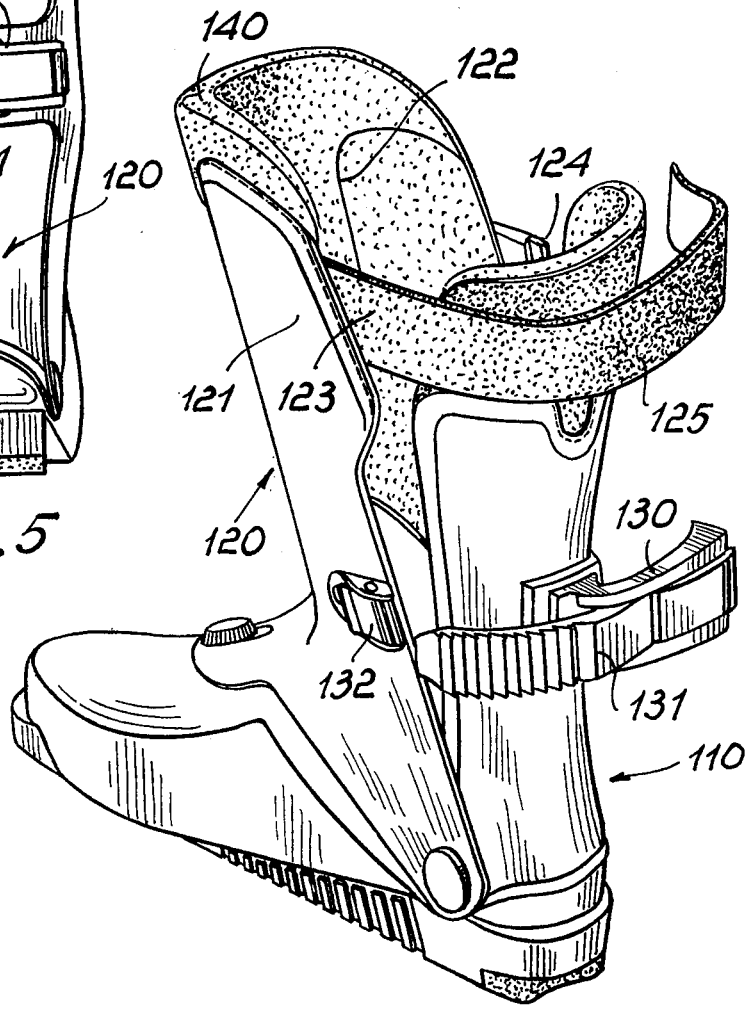

SKI BOOT

BACKGROUND OF THE INVENTION

This invention relates to a ski boot.

Today's ski boots made of a plastics material are known to comprise a shell whereon, at the foot neck level, a short calf-piece or raised upper is provided which, in general, has its top end located slightly above the ankle. Moreover, that raised upper provides rearward support for the wearer's leg through a fairly high rear flap, whereas the front of the raised upper is always made slightly lower to facilitate a limited flexing movement of the leg with respect to the foot.

Such ski boots afford ski control capabilities through the clamping action exerted by latch levers on the skier's foot, thereby the skier's foot actually becomes one thing with the boot. Thus, it is necessary that the closure at the foot neck be fairly tight, which could result in poor blood circulation through one's feet, awkward deambulation, and anomalous squeezing of the calf and shin.

Furthermore, it should be appreciated that the weakest section of the shin is located at one eighth of the ankle-to-knee distance from the ankle, and this is indeed the area where traditional ski boots are terminated, with consequent potential risk of breaking one's tibiae against the top edge of the ski boot raised uppers.

With a view to eliminating such drawbacks, various solutions have been proposed, which provide raised uppers of increased height, thus bringing the top edges thereof to a level just below the skier's knee, thereby they practically encircle the entire lower portion of the skier's leg.

Such solutions, as disclosed in previous patents, have failed to prove practicable because they generally provide a fairly shallow body shell, whereto a raised upper or calf-piece is hingedly connected which is virtually rigid and clamps the leg along the tibia both on the front and rear, thus drastically restricting all the possibilities for leg-to-foot articulation, both while actually skiing and simply walking. Moreover, a tight fitting of the raised upper against the skier's calf results, here too, in considerable wearer's discomfort.

SUMMARY OF THE INVENTION

This invention sets out to eliminate the problems encountered with conventional ski boots, as mentioned, by providing a novel ski boot design which affords full sideway and fore-and-after control of the skis, while leaving the skier's feet naturally unrestricted.

Within that general aim, it is possible to arrange that the ski boot of the present invention, while affording a secure retention of the skier's foot within the ski boot, only requires much reduced latching means which are positioned to cause no discomfort to the wearer.

It is further possible to arrange that the ski boot of this invention affords the highest degree of protection for the skier's limbs, thus making bone fracturing a most unlikely occurrence.

It is further possible to arrange that the ski boot according to this invention avoids any leakage of snow or water into the ski boot, while inducing no tiring effects in the skier's legs as a result of prolonged wearing.

According to one aspect of the present invention, there is provided a ski boot characterized in that it comprises a substantially rigid plastics material shell including a toe portion of the ski boot and a shallow portion at the heel portion thereof, there being associated with said shell a raised upper or quarter located at said shallow portion and a raised vamp, formed from a substantially rigid plastics material, said raised vamp covering the skier's leg front along the tibia and widening out at its top end, below the skier's knee, to at least in part engage the skier's leg laterally, said raised upper and raised vamp being both hinged to said shell for pivotal movement about a substantially horizontal axis extending perpendicularly to said shell centerline, at a point located at the malleolus, means being further provided for interengaging said raised upper and raised vamp, as well as a band element surrounding the skier's leg along the top end of said vamp.

BRIEF DESCRIPTION OF THE DRAWINGS

Further features and advantages will become more clearly apparent from the following description of a preferred, though not limitative, embodiment of this ski boot, illustrated by way of example only in the accompanying drawings, where:

FIG. 4 is a rear perspective view of a different embodiment of this ski boot;

FIG. 5 is a rear view of the ski boot of FIG. 4;

DESCRIPTION OF THE PREFERRED EMBODIMENTS

Figure 1:
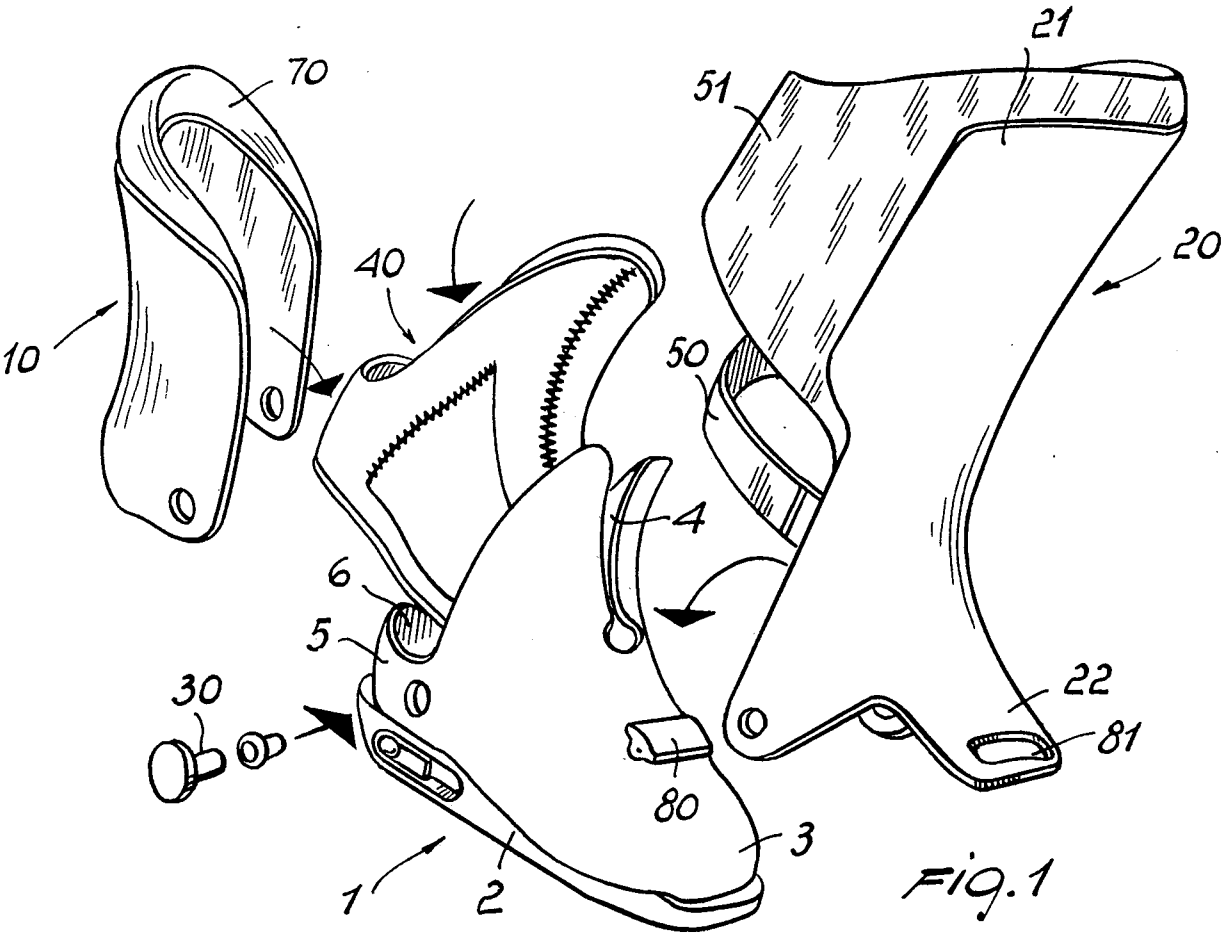
FIG. 1 is an exploded view representation of the ski boot according to this invention.

With reference to the drawing figures, the ski boot of this invention comprises a foot portion defined by a shell, generally indicated at 1, which includes a substantially rigid sole 2, wherewith there is associated, preferably as an integral part thereof, a front portion 3 occupying the area from the toe end to the foot neck and defining a longitudinal slot 4 intended for improving the flexibility of the foot neck region. The shell 1 further includes a rear portion 5 located beneath a shallow portion 6 of the shell.

The shell 1 is preferably formed from a substantially rigid plastics material of the type marketed under the tradenames of Nylon or PU, but other suitable materials may be utilized instead.

With said shell, there is associated a quarter or raised upper, generally indicated at 10, which is located at said shallow portion to enclose said shell on the rear.

With that same shell 1, there is associated a raised vamp 20 formed from a substantially rigid plastics material, of the type of high-density polyethylene, which covers the front of the skier's leg at the tibia region, and which widens out into lateral wings 21 which, at their top ends are generally located just below the knee and engage at least partially with the skier's leg sides. Thus the raised vamp has a length dimension with respect to the shell 1 such as to terminate substantially proximate to the skier's knee.

Said raised vamp has a bottom shaped flap 22 which overlaps, at least in part, the cited front or toe portion 3 of the shell 1.

A basic feature is that both the raised upper 10 and raised vamp 20 are hingedly connected, about a common axis, to the cited shell 1, and more specifically, they are allowed to pivot about a substantially horizontal axis which extends perpendicularly to the centerline of the sole 2, and accordingly of the shell 1, at a point located substantially at the malleolus of the skier's leg. For said pivotal engagement, there are provided, on opposite sides of the shell 1, pivot members which are only schematically shown in the drawings and indicated at 30.

The ski boot is then completed with a soft and flexible inner footwear 40, which is introduced into the shell 1 and has substantially the same shape as the shell 1, its one function being that of providing an adequate thermal insulation and greater comfort for the skier's foot.

Figures 2, 3:
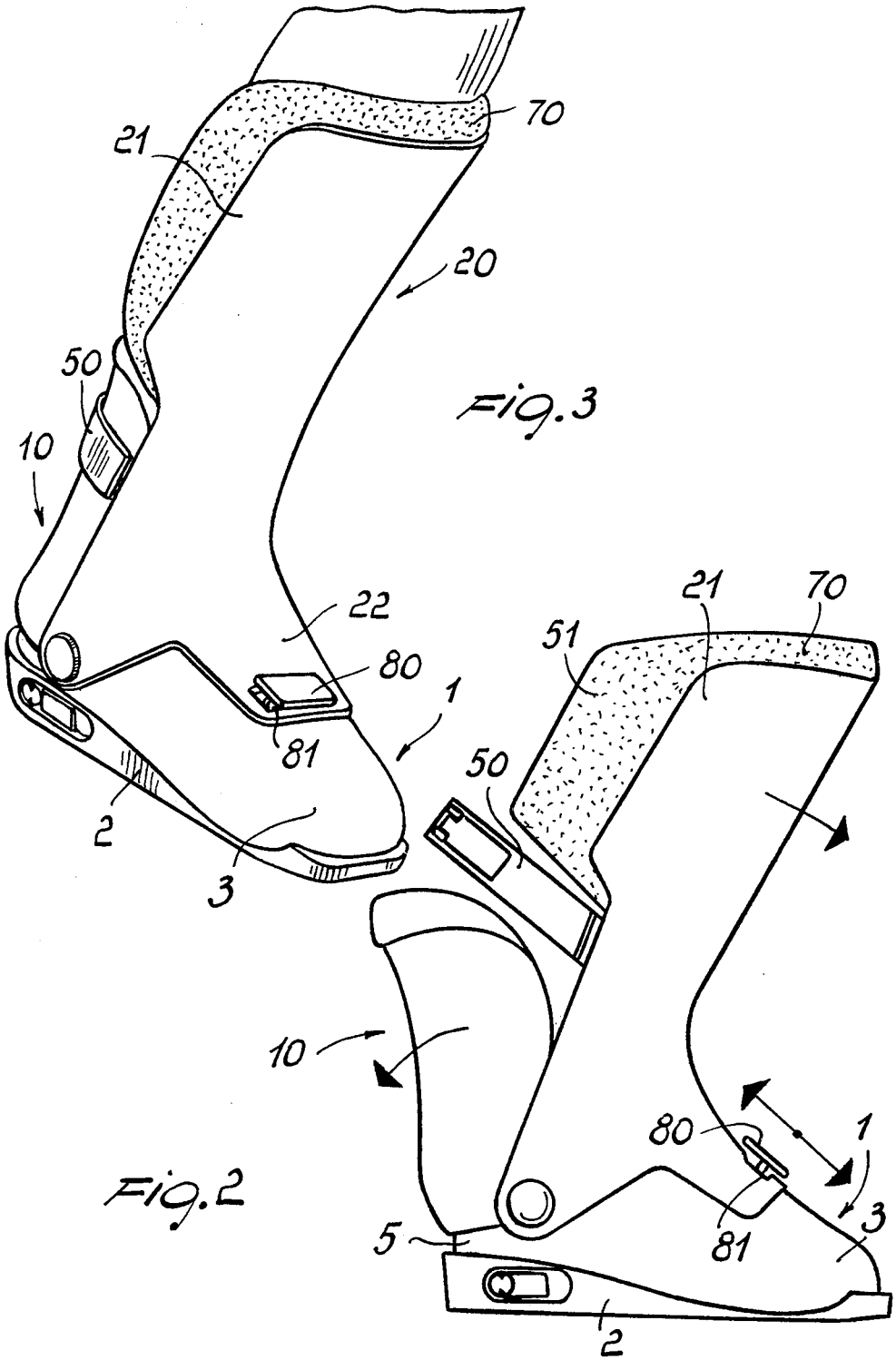
FIG. 2 shows the ski boot in its open or unlatched condition.
FIG. 3 shows the ski boot in its closed or latched condition.

The closure or latching means mounted on the ski boot comprise, according to this invention, latching means active between the raised vamp 20 and raised upper 10, which means are composed of a lever or the like, as indicated at 50 in the drawings, and engage the raised upper 10 with the raised vamp 20 to firmly surround the skier's leg as shown in FIG. 3.

Furthermore, in order to provide backing support, there is provided a band element 51 located at the top end of the raised vamp 20, at the wings 21, and adapted for encircling the leg rear and holding the raised vamp 20 in engagement with the skier's leg at an upper region near to the skier's knee. In this instance, it will be possible to provide a closure element comprising, for example but not necessarily, a pull strap or the like.

It should be further added that on the inside of the raised upper and vamp there are provided adequate paddings, as generally indicated at 70 in the drawings.

Moreover, it should be added that in order to limit the possibility of the vamp 20 pivoting with respect to the shell 1, a mushroom-like button 80 may be provided rigid with the shell 1 and projecting from the top front portion of the shell, said button being insertable for a limited relative movement through a window or slot 81 correspondingly provided in the flap 22 of the raised vamp 20. As visible in the drawings, the mushroom-like button 80 as a shank portion having a cross dimension smaller than the slot 81.

According to a different embodiment shown in FIGS. 4 to 7, to the shell 1 there is associated a raised upper, indicated at 110, which occupies the cited shallow portion, i.e. also closes the shell 1 on the rear, and extends upwards to the skier's calf, thus attaining substantially the same height as the raised vamp.

Again to the shell 1, there is associated a raised vamp 120, having the same configuration as the raised vamp 20, of a substantially rigid plastics material, which has side wings 121 and a front cutout of V-like shape, as indicated at 122 at the top portion of the vamp 120. The closure means comprise in this instance a pull strap 123, which extends from one of the wings 121 and can be inserted through a ring 124 provided in the other wing 121, thereby by pressing the two flaps one against the other the desired closure is accomplished, to also hold tightly secured the raised upper indicated at 110, which extends substantially up to the height of the skier's knee as does the raised vamp 120.

The advantages afforded by this type of closure reside in an extremely quick closing action, good holding power, and by using a pull strap of suitable width, an optimum distribution of the load is achieved without inducing pain in the leg around the wrapping region.

On the rear of an edge of the raised vamp 120, at the area occupied by the ankle, there is provided a lever 130 whereto is articulated one end of an adjusting strap 131 which engages with a locking lever 132 provided on the raised vamp 120.

This type of closure secures the advantage of having at all times the same lever arm for the lever 130 at any closure position.

Moreover, to complete open or unlatch the ski boot, one operates the locking lever 132 to release the adjusting strap 131, whilst the ski boot loosening during waiting intervals, as at the "ski lifts" becomes a very simple operation, because it is sufficient to swing the lever 130 open; when the ski boot must be tightened, that same lever is simply closed without having to re-locate the ideal closure position.

It should be added to the above that at the V-like cutout 122, there is provided a padding 140 which provides a far more comfortable support for the tibia, while increasing the forward flexing angle without prejudice for an optimum control of the ski side response, on account of the substantially rigid wings 121 engaging the leg sides.

Figure 8:
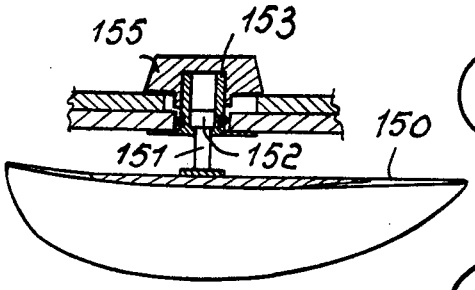
FIG. 8 is a sectional view of the pressure means for latching the ski boot closed.
Figure 9:
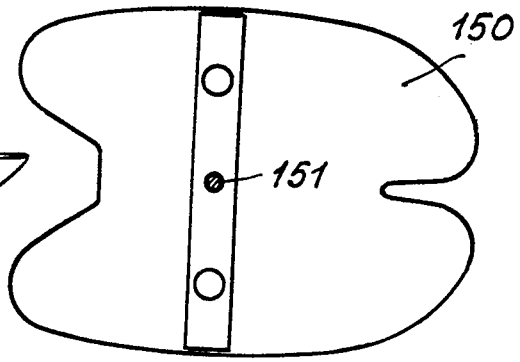
FIG. 9 shows the pressing element of the pressure means.
Figure 6:
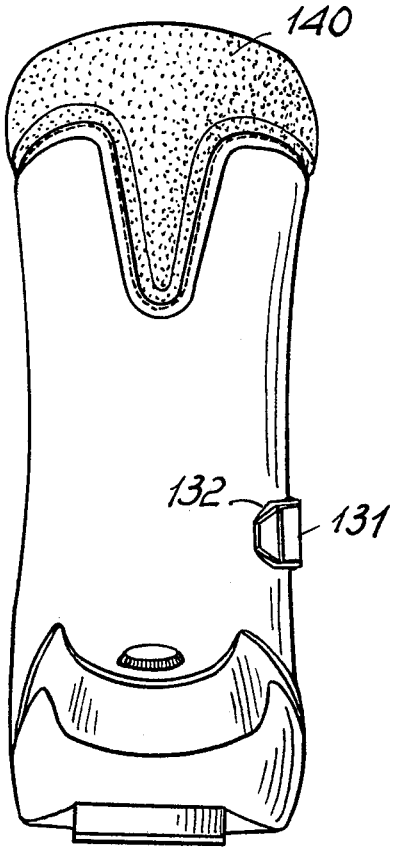
FIG. 6 is a front view of the ski boot of FIG. 4.
Figure 7:
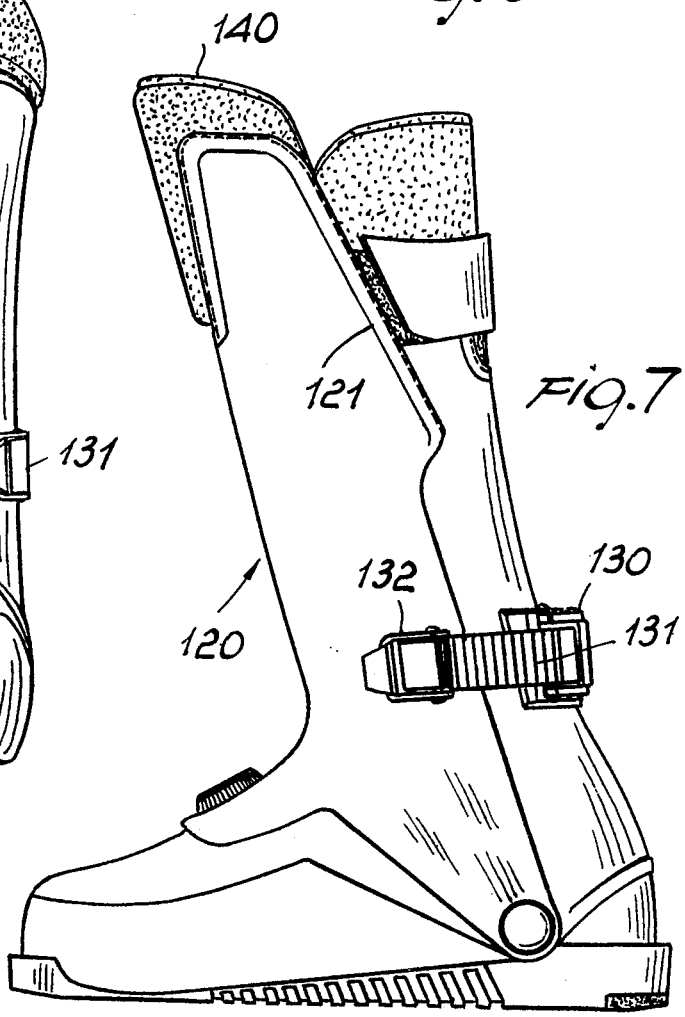
FIG. 7 is a side view of the ski boot of FIG. 4.

To provide an appropriately tight fitting of the ski boot on the foot neck, there is provided a pressure element 150 (FIGS. 8 and 9), which is supported by a shank 151 terminating at the top in a threaded body 152 adapted for rotatably engaging with the inside of a ring nut 153 penetrating the thickness of the shell 1 and raised vamp 120 or 20, there being provided externally a knob 155 for adjusting the pressure element, since one full rotation of the knob results in an upward or downward travel of the pressure element 150.

Thus, the knob 155 operates an inner part, comprising the pressure element 150, which is effective to lock to a greater or lesser extent the foot neck while maintaining the foot correctly positioned inside the ski boot.

The ski boot of this invention can be used in an extremely simple manner. In fact, it will be sufficient for the user, who intends to put on the ski boot, to arrange it in the open or unlatched position, as shown schematically in FIG. 2, i.e. with the raised upper tilted backward and the raised vamp 20 shifted forward; in this position, the user is enabled to conveniently put on the inner footwear 40 first, which is preferably of the removable type, thereafter, to effect the closure of latching the ski boot, it will be sufficient for the user to close the lever or latch 50 which firmly connects the raised upper 10 and raised vamp 20 to each other, thereafter the user will close the strap element 51, thus engaging the raised vamp 20 with his/her leg.

It should be noted that with the foregoing structure, the skier's foot is no longer costrained in a small space where it remains squeezed tightly, but is instead fairly naturally retained therein, since the lever 50 applies no anomalous or inconvenient pressures to the skier's muscles, it merely engaging the raised upper 10 and raised vamp 20 together, such as to result in an effective but not uncomfortable restraint of the skier's leg; moreover, the band element 51 provides rearward support without causing aching muscles as conventional ski boots did.

It should be emphasized here that by restricting the raised upper 10 to the rear of the ski boot, a self-locking effect is achieved; in other words, the more it flexes forwards the more it automatically locks the skier's foot without exerting those anomalous pressures on the foot which characterize conventional ski boots.

Another interesting aspect is that, contrary to ski boots of conventional design, the instant ski boot has its front portion considerably higher than its rear portion.

It should be further added to the foregoing that by providing a ski boot which is considerably more elongated longitudinally with respect to the skier's leg, ski control is greatly improved because the lever arm is increased in banking, thus affording ideal side stability capabilities.

Moreover, as mentioned, the risk of the ski boot edges fracturing one's tibiae is eliminated, since such edges are located higher up along the tibiae and closer to the knee, to protect the weakest area of the tibia, which as mentioned lies at one eighth of the distance from the ankle to the knee, as measured from the ankle.

Another important advantage is that water leaks into the boot are fully prevented by the shell 1 being completely closed at the front, thereby no tightness problems are to be solved which were typical of conventional ski boots having an open front area.

Furthermore, no disengagement of the boot while flexed is experienced because the pivotal movement of both the raised upper and raised vamp entirely occurs at the malleolus area, where the pivots 30 are provided.

Finally, it should be mentioned that a higher degree of safety is achieved in the automatic release from the skis, in that a longer lever arm is provided by the raised vamp 20 which favors such a release action.

The invention as described and illustrated herein is susceptible to many modifications and variations, all of which fall within the scope of the instant inventive concept.

Moreover, all of the details may be replaced with other technically equivalent elements.

In practicing the invention, the materials used, and the dimensions and shapes, may be any ones to suit individual application requirements.

I claim:

1. A ski boot comprising in combination:

(a) a foot portion comprising a substantially rigid shell made of plastics material; said shell having a toe portion and a heel portion;

(b) a leg portion comprising a rear raised upper and a front raised vamp, said raised upper and raised vamp being made of substantially rigid plastics material, at least said raised vamp having a length dimension with respect to said shell such as to terminate substantially proximate to the skier's knee;

(c) wings integral with said raised vamp laterally thereto for at least in part engaging the skier's leg laterally;

(d) means for pivotally connecting said raised upper and said raised vamp with said shell about a common axis extending substantially perpendicularly to a longitudinal centerline of said shell and lying substantially at the region of the skier's malleolus;

(e) means for engaging said raised upper with said raised vamp to firmly surround the skier's leg;

(f) means on said raised vamp for encircling the skier's leg rear and holding said raised vamp in engagement with the skier's leg at an upper region near to the skier's knee;

(g) means for allowing limited pivotal movement of said raised vamp about said axis.

2. A ski boot as claimed in claim 1, wherein both said raised vamp and said raised upper extend substantially up to the skier's knee.

3. A ski boot as claimed in claim 1, wherein said raised vamp has a substantially V-like shaped cutout in a top front portion thereof, and a padding in the region of said cutout.

4. A ski boot as claimed in claim 1, wherein said means for allowing limited pivotal movement of said raised vamp about said axis comprise a shaped flap integral with said raised vamp at a bottom front portion thereof, a slot in said flap, a mushroom-like button projecting from said shell and penetrating said slot, wherein said mushroom-like button has a shank portion having a cross dimension smaller than said slot.

* * * * *